United States Patent [19]

Raab

[11] 4,168,705

[45] Sep. 25, 1979

[54] FLOAT AND CHECK VALVE FOR HYDROTHERAPY UNIT AIR INTAKE

[75] Inventor: Alfred Raab, Willowdale, Canada

[73] Assignee: Jacuzzi Bros., Inc., Little Rock, Ark.

[21] Appl. No.: 801,622

[22] Filed: May 31, 1977

[51] Int. Cl.[2] ..... A61H 9/00

[52] U.S. Cl. ..... 128/66; 137/202

[58] Field of Search ..... 128/66, 145 A; 4/180; 137/202

[56] References Cited

U.S. PATENT DOCUMENTS

| | | | |
|---|---|---|---|
| 701,428 | 6/1902 | Walsh | 137/202 |
| 2,663,178 | 12/1953 | Schwartz | 128/66 |
| 3,152,604 | 10/1964 | Frye et al. | 137/202 |
| 3,286,712 | 11/1966 | Roden | 128/66 |
| 3,367,325 | 2/1968 | O'Keefe | 128/66 |
| 3,768,498 | 10/1973 | Urban | 137/202 |
| 3,908,647 | 9/1975 | Tauntou | 128/145 A |

FOREIGN PATENT DOCUMENTS

| | | | |
|---|---|---|---|
| 211509 | 7/1909 | Fed. Rep. of Germany | 137/202 |
| 808934 | 7/1951 | Fed. Rep. of Germany | 137/202 |
| 957920 | 2/1957 | Fed. Rep. of Germany | 137/202 |
| 127939 | 5/1919 | United Kingdom | 137/202 |

*Primary Examiner*—Lawrence W. Trapp

*Attorney, Agent, or Firm*—Hill, Van Santen, Steadman, Chiara & Simpson

[57] ABSTRACT

A one-way flow check valve is placed over an air inlet conduit to a hydrotherapy unit to prevent back flows of air and water up through and out of the conduit when the hydrotherapy nozzle outlet is blocked. A body of the valve contains a vertically-movable float which normally rests upon a retainer ring in a downward, air suction position. The float is raised upwardly and against a valve seat upon reverse flow of air and water. The light weight, buoyant construction of the float, as a hollow plastic member with top and side walls, allows the valve to shut off reverse flows of water whether fast or slow moving and to respond also to fast reverse flows of air ahead of a rising column of water. A retainer ring with float abutment pins retains the float in the body removably for cleaning the valve surfaces.

17 Claims, 6 Drawing Figures

Fig. 3
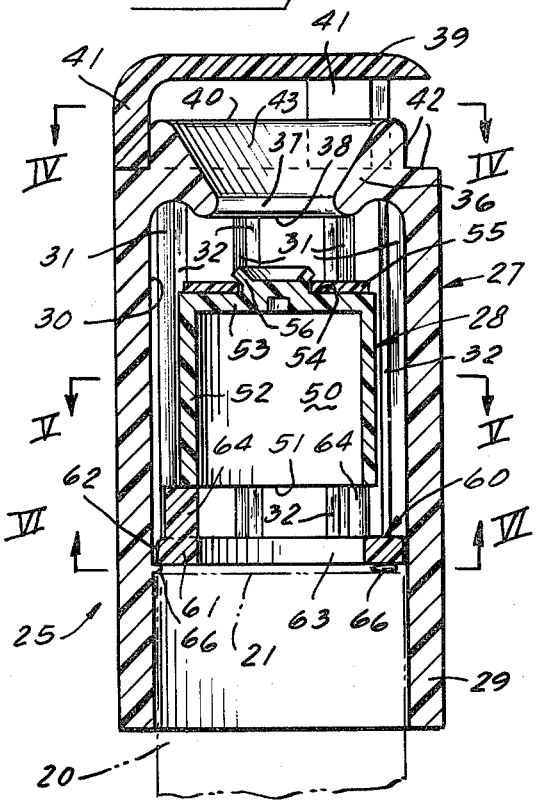
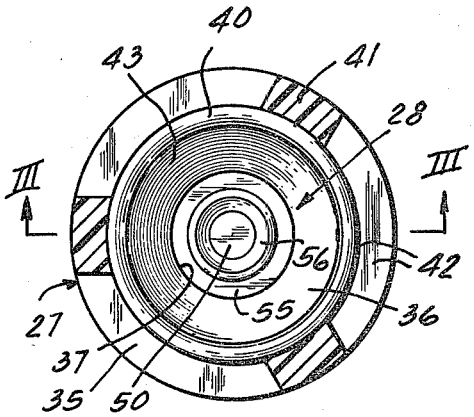
Fig. 4
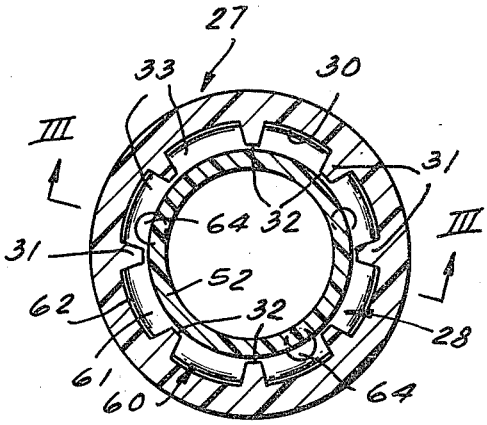
Fig. 5
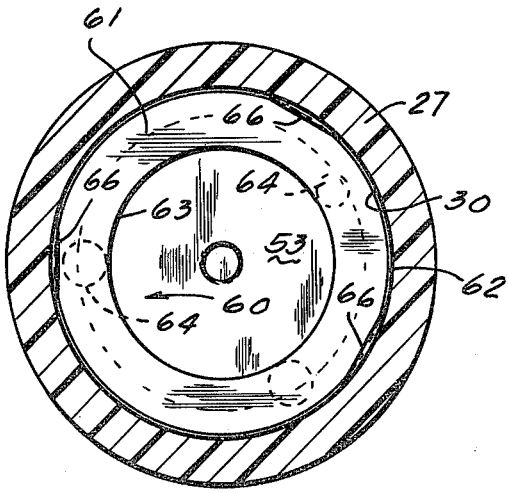
Fig. 6

FLOAT AND CHECK VALVE FOR HYDROTHERAPY UNIT AIR INTAKE

BACKGROUND OF THE INVENTION

1. Field of the Invention

The present invention relates to equipment used to control flows of air and water to fittings used to combine air with pressurized water streams for aeration, hydrotherapy, and like purposes, and especially to vertical-axis, one-way flow valves for low pressure applications.

2. The Prior Art

Hydrotherapy fittings for aerating streams of water directed into a pool or bath of water below the surface thereof are shown in U.S. Pat. Nos. 3,297,025 and 3,905,358. In such devices, a stream of water is introduced into a nozzle submerged in the body of water. An air inlet zone about the periphery of the nozzle or, in the later-issued patent, in the center of the nozzle, is connected to atmosphere and draws air by venturi action into the stream of water. The air emerges from the nozzle as bubbles within the stream of water, to provide a vigorous massage of the body of the bather. During normal operation of the hydrotherapy or whirlpool bath, if the nozzle outlet is blocked with a hand or foot or with a wash rag, the water pressure will back up water into the air line, normally necessitating that the air line be connected to a drain over flow or back into the pool of water. Even in such arrangements, blockage of the nozzle can create a spray from the top of the air intake line, undesirably wetting adjacent areas. While one-way flow check valves are known generally in the art, no simple, inexpensive, and light weight check valve specifically adapted for use with the peculiar requirements of hydrotherapy nozzles is generally available.

SUMMARY OF THE INVENTION

A float and check valve adapted for use with a hydrotherapy nozzle allows free axial flow of air in a downward direction and blocks any upward, reverse flow of water arising from blockage of the hydrotherapy nozzle outlet. A light weight plastic float is slidable in a ribbed bore of the valve body. The float is open at the bottom and has closed top and side walls to form an air chamber or bell to assure buoyancy thereof. A retaining ring releasably secures the float in the body. Downward air flow passes around the float and between the ribs, while upward flows of air and water urge the float upwardly into sealing engagement with a valve seat. Slow flows of water will buoy the float into sealing position, while rapid flows of water or air will by their pressure alone force the float to seal the valve.

THE DRAWINGS

FIG. 3 is a side sectional view through the float and check valve of the invention in assembled condition.

FIG. 4 is a cross-sectional view taken on line IV—IV of FIG. 3.

FIG. 5 is a cross-sectional view, taken on line V—V of FIG. 3, and showing thereon the orientation of FIG. 3 at III—III.

FIG. 6 is a cross-sectional view, taken on line VI—VI of FIG. 3.

THE PREFERRED EMBODIMENTS

Figure 1:
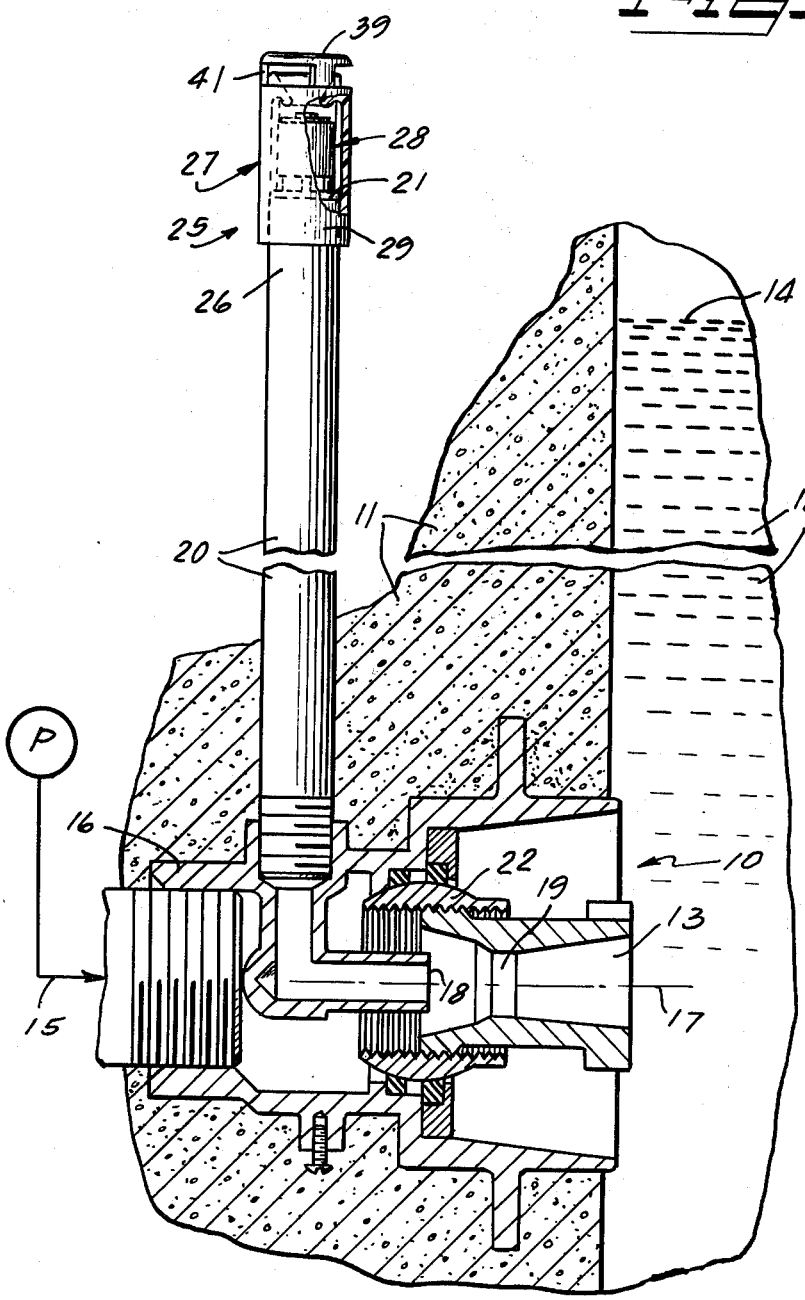
FIG. 1 is a side sectional view, partly broken away, through a hydrotherapy unit with float valve.
Figure 2:
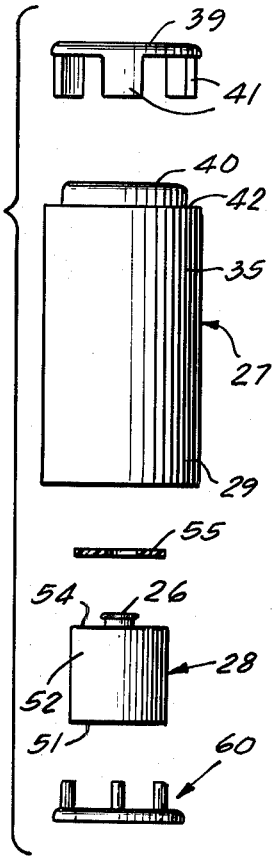
FIG. 2 is an exploded view in side elevation of the float and check valve of the invention.

A hydrotherapy nozzle unit 10 is provided in a wall 11 of a body 12 of water such as a swimming pool, bath, or spa, with an outlet 13 from the nozzle unit 10 being submerged below a surface 14 of the body of water 12. A pump P such as a swimming pool filter or a motor driven pump provided specifically for the purpose provides a flow of water 15 under pressure into a rear connection 16 to the hydrotherapy unit 10. The pressurized water flow 15 flows along an axis 17 of the hydrotherapy unit 10 and past an air inlet port 18 disposed centrally in the flow about the axis 17. The flow continues through a nozzle bore 19 for mixing of the air from the port 18 with the water from the pump P. The flow of water about the air inlet port 18 creates a venturi or suction action, which draws atmospheric air through a conduit 20 which generally extends above the level 14 of the body of water 12, to an upward termination 21, as shown.

The advantages of the particular hydrotherapy nozzle arrangement shown, and further structural features thereof such as the universal joint mounting 22, are fully developed in the U.S. Pat. No. 3,905,358, issued to the assignee of the present invention on Sept. 16, 1975. Any other hydrotherapy unit such as that disclosed in U.S. Pat. No. 3,297,025, also issued to the assignee of the present invention, may also be employed. In this earlier patent, a stream of water is introduced under pressure into the center of a nozzle submerged in a pool or bath of water. Air inlet zones about the periphery of the nozzle are connected to atmosphere through a conduit and serve to draw air by venturi action into the stream of water from the outside of such stream.

In all of such prior art devices, water will flow whenever the pump P is not operating through the air inlet port 18 and into the conduit 20 to the water level 14 of the body of water 12. When the pump P does operate, the venturi action clears the conduit 20 and air inlet 18 of such water for normal operation. However, if the outlet 13 from the nozzle assembly 10 is restricted or blocked while the pump P is operating, as from the hand or foot of the user or by a wash cloth inadvertently or playfully pressed against the nozzle 13, pressurized water from the flow 15 will enter the air inlet 18 and can shoot with substantially full pump force out the top end 21 of the air intake conduit 20. The virtual certainty of such back up of pressurized water at some point during operation of the hydrotherapy unit 10 requires that the air conduit termination 21 be located in a drain overflow area or for draining back into the body of water 12, or that some other provision be made for containing water exiting from the upper end 21. In some installations the air conduits 20 of several hydrotherapy units 10 are connected together and run to a mechanical room to terminate in a large-size check valve for preventing water from spilling out.

In accordance with the principles of the present invention, a float and check valve assembly 25 is fitted onto an upper end 26 of the conduit 20 about the upper end 21 thereof. The float and check valve 25 principally comprises, as shown in the drawing figures, a tubular valve body 27 and a float 28 slidably received within the body 27. A lower end 29 of the tubular body 27 snugly engages about the upper end 26 of the conduit 20, in a press-fitting relationship providing a water tight seal between the parts and a joint resistant to separation under water pressures to be contained in the conduit and valve.

An annular inner wall 30 of the tubular body 27, beginning upwardly of the bottom end portion 29 thereof, carries a plurality of axially extending ribs 31 projecting radially inwardly therefrom. Each rib 31 has an axially extending guide surface 32 spaced inwardly from the inner wall 30, and a flow passage 33 is formed by spaces between the ribs 31.

An upper end 35 of the valve body 27 has a radially inwardly-extending portion 36 forming a top opening 37 with an annular valve seat 38 on an undersurface thereof, in the interior of the valve body 27. The top opening 37 is protected against entry of foreign particles thereinto by a protective cap 39 which is spaced upwardly from an upper lip 40 of the inlet 37. The cap 39 is held in place by integrally molded legs 41 adhesively engaging a recess 42 about the top end 35 of the valve body 27. Air can flow freely into the top opening 37 beneath the protective cap 39, but foreign particles are at least partially excluded by the fairly sharp flow angles presented. A conical surface 43 joins the lip 40 and the top opening 37.

The float 28 is carried within the valve body 27, inwardly of the guide surfaces 32 of the ribs 31. The float 28 comprises a unitary float member 50 having an open bottom 51, an annular side wall 52 freely receivable in the space defined by the guide surfaces 32 of the ribs 31, and a top wall 53 joined to the side wall 52 to form an air bell chamber within the float member 50. The float 28 is comprised of a light plastic, such as ABS (Cycolac), grade T. The float 28 further has a vertical or axial length sufficient in view of the clearances between the outside of its side wall 52 and the rib guide surfaces 32 to maintain itself in a vertical orientation without cocking or binding therein.

A top surface 54 of the float member 50, on the top wall 53, is annular in form and is sized to abut cleanly against the valve seat surface 38 in the upper portion 35 of the valve body 27. It has been found that the plastic-to-plastic contact between the surfaces 54 and 38 if carefully controlled will provide a good seal against leakage of water and air out the top opening 37 when the float 50 is urged upwardly. It is preferably, however, to provide a gasket 55 over the surface 54 to insure that the seal is absolutely water and air tight regardless of minor manufacturing variations. The gasket 55 may be any form of flexible, resilient rubber material such as neoprene. A hole formed in the center of the gasket 55 permits the gasket to be retained on the top wall surface 54 of the float 50 by an outwardly-flared retaining post 56 formed on the axis of the float 50. Although the retaining post 56 extends above the surface of the gasket 55, the post 56 extends in the raised position of the float 50 into the top opening 37 and does not interfere with the valve seat 38. Since the gasket 55 is resilient, it may be stretched slightly for assembly about the post 56 for initial assembly, cleaning, and replacement.

To retain the slidable float 28 in the valve body 27, a retainer ring 60 is provided having an annular portion 61 with an outer wall 62 sized to be received within the inner wall surface 30 of the valve body 27. The retainer ring 60 has an inner cut out portion 63 for passing air and water upwardly and downwardly through the upper portion of the valve body 27. At least one and preferably three abutment pins 64 are formed integrally with the retainer ring annulus 61 and extend upwardly therefrom to abut against the lower surface of the side wall 52 of the float 28 in all radial positions thereof during downward flow of air through the valve 25 or while the system is at rest. The abutment pins 64 are circumferentially spaced about the axis of the retainer ring 60 to project into the spaces 33 among the guide ribs 31, as shown in FIG. 5. The retainer ring itself is maintained in position abutted against lower ends 65 of the guide ribs 31 by at least one and preferably three inwardly-projecting nubs 66 molded into the inner wall 30 of the valve body 27. The nubs 66 are very small in radial dimension, so that the retaining ring 60 and/or the side wall of the valve body 27 can flex sufficiently to pass the retainer ring 60 upwardly or downwardly when some axial pressure is applied thereto. By this arrangement, removal of the valve body 27 from the conduit 20 and removal of the retainer ring 60 from the valve body 27 through its lower end 29 frees the float 28 from within the valve body 27 for inspection and cleaning as may be necessary.

In operation, once the float and check valve 25 has been assembled and placed over the upper end 26 of the conduit 20 leading to the hydrotherapy unit 10 and the air intake port 18 thereof, the float 28 will permit passage of air downwardly beneath the protective cap 39, through the top opening 37, through the passage spaces 33 between the guide ribs 31 and about the top wall 53 and side wall 52 of the float 28, and through the interior space of the retainer ring 60. In this mode, the hydrotherapy unit 10 is unaffected by the presence of the float and check valve 25.

When the outlet 13 from the nozzle of the hydrotherapy unit 10 is restricted or blocked from passing full flow of the pump P, pressure at the air inlet port 18 increases, driving air back out of the conduit 20 in a reverse flow. Because the float 28 is very sensitive to pressure variations across its top wall 53, due to its light weight and also its open-bottom shape, it may happen that if the blocking of the nozzle outlet 13 is sufficiently rapid, the float 28 will rise and seal the top wall 54 and gasket 55 against the valve seat 38 even before any appreciable amount of water has entered through the port 18 or into the conduit 20. Once the float 50 has sealed against the seat 38, only a relief of the pressure through the air intake port 18 can release the valve 28 for downward flow of air through the float and check valve 25. Where the restriction of the nozzle 13 is more gradual, it may be that the air passing through the valve 25 is not a sufficiently strong flow to activate the float 28. However, once the water level does reach the bottom 51 of the float 28, the float 50 will tend to float buoyantly on the surface of the water and will rise with the rise in water until the top surface 54 and gasket 55 thereon engage the valve seat 38. At that point the water level will rise only to compress the air within the valve body 27, but no more air will escape through the top opening 37. Once the blockage of the outlet 13 is removed, water will flow back downwardly through the retainer ring 60 and conduit 20 and out the air inlet port 18, followed by air newly admitted through the unseated valve 25.

Although various minor modifications may be suggested by those versed in the art, it should be understood that I wish to embody within the scope of the patent warranted hereon all such modifications as reasonably and properly come within the scope of my contribution to the art.

I claim as my invention:

1. A float check valve comprising:
an elongated tubular unitary body having
an annular inner wall, with a substantially constant diameter and a top member at an upper end of the body forming a valve top opening and a peripheral valve seat on an underside thereof; at least one nub selectively affixed to said annular inner wall of said body, said body having an open lower end of a diameter substantially equal to said diameter of said body,
a float having a side wall and a top wall, said float being slidably received in said tubular body inwardly of said annular wall and carrying on said top wall, a removably mounted, compressible sealing means operable to seal against said valve seat;
and a retainer removably engaging said nub, the retainer receiving the float in abutting, underlying relation thereto in an open position of the valve, and operable to retain said float within said body member, said retainer being located between said nub and said float and being flexible so as to be slidable past said nub and removable through said open lower end so that said float might also be removed through said port for cleaning or repair,
whereby in a first flow condition fluid is passed downwardly through said valve top opening, about said float, and past said retainer and in a second, opposite flow condition fluid passing upwardly through said body urges said float in an upward direction so that said sealing means of said float sealingly engages said valve seat.

2. A float and check valve as defined in claim 1, wherein the inner wall carries a plurality of radially inwardly-extending, elongate guide ribs spaced circumferentially about the inner wall and spaced radially for guiding the float therealong.

3. A float and check valve as defined in claim 1, wherein the float is hollow and the side and top walls form an upwardly-closed air chamber to ensure positive buoyancy of the float with respect to water.

4. A float and check valve as defined in claim 1, wherein said sealing means comprises a resilient gasket, said gasket being compressible between said valve seat and said float to seal against fluid passage in the second direction.

5. A float and check valve as defined in claim 4, further comprising a tapered member extending upwardly and radially outwardly from a center of said top wall of said float, the member receiving said gasket over its taper and retaining it on said top wall of said float, and wherein said tapered member is receivable into said top opening of said top member.

6. A float and check valve as defined in claim 1, wherein said retainer comprises an annular ring received within said lower portion of said tubular body between said float and said nub.

7. A float and check valve comprising: an elongated tubular body having
an annular wall, and
surface means at an upper end of the body forming a top opening and a peripheral valve seat on an underside thereof;
a float having side wall and a top wall, the float being slidably received in said tubular body inwardly of said inner wall and carrying an annular valve surface on said top wall thereof; and
a retainer engaged in a lower portion of the tubular body, the retainer receiving the float in abutting, overlying relation thereto in an open position of the valve,
whereby in a first flow condition fluid is passed downwardly through the valve top opening, about the float, and past the retainer and in a second, opposite flow condition fluid passing upwardly through the body urges the valve surface of the float sealingly against the valve seat; wherein the retainer comprises an annular ring received within the lower portion of the tubular body and; wherein the retainer further comprises at least one abutment pin extending axially upwardly from the ring and into contact with the float in the first flow condition thereof.

8. A float and check valve comprising:
an elongated tubular body having an annular wall, and
surface means at an upper end of the body forming a top opening and a peripheral valve seat on an underside thereof,
a float having side wall and a top wall, the float being slidably received in said tubular body inwardly of said inner wall and carrying an annular valve surface on said top wall thereof; and
a retainer engaged in a lower portion of the tubular body, the retainer receiving the float in abutting, overlying relation thereto in an open position of the valve,
whereby in a first flow condition fluid is passed downwardly through the valve top opening, about the float, and past the retainer and in a second, opposite flow condition fluid passing upwardly through the body urges the valve surface of the float sealingly against the valve seat;
wherein the retainer comprises an annular ring received within the lower portion of the tubular body and; wherein the retainer is snap-fittingly retained in the tubular body by at least one nub extending into engagement therewith inwardly from the inner wall of the body below the retainer.

9. A float and check valve as defined in claim 1, further comprising a protective cap spaced above said top opening to form thereunder a passage for fluid into said opening while blocking downward passage of foreign matter into said opening.

10. In combination with an air inlet to a hydrotherapy nozzle, the nozzle mixing air from an air intake conduit with a stream of pressurized water, a float and check valve comprising:
a vertical axis tubular valve body having
an annular wall,
a lower end received on said air intake conduit, and
surfaces forming a top air inlet radially inwardly of said wall and a downwardly-facing valve seat; and
a valve float received in said valve body in axially slidable relation thereto,
said float being buoyant upon water, and having
a valve surface on an upper portion thereof engageable against the valve seat surface in a raised position of the float to form a liquid-tight seal therewith.

11. In combination,
a hydrotherapy nozzle assembly having an inlet for a stream of pressurized water, a suction inlet for passing atmospheric air into said stream, and an outlet for a flow of aerated water;
a conduit means for connecting said suction inlet to atmosphere and having an upper end; and a float and check valve having a tubular body sealingly received on said upper end of the conduit, an annular wall forming a generally vertical flow passage through the body, a valve seat surface on an upper portion of the body, and a valve float slidable in the body and sealingly engageable with the seat surface upon a rise in water level in the conduit and body about the float.

12. The combination defined in claim 11, wherein the float and check valve is comprised of a plastic material and the float is a hollow member open at the bottom and having side and top surfaces forming an air bell therein, whereby to assure positive buoyancy of the float.

13. The combination of claim 11, wherein a resilient gasket is carried by a top surface of the float, thereby to seal the seat surface and the float against passage of air and water therebetween.

14. The combination of claim 11, further comprising:

a plurality of radially inwardly-extending, elongate ribs on said annular wall, said ribs having inward surfaces for guiding the float in a selected fixed orientation with respect thereto; and an annular retainer ring retained in a lower portion of the valve body upwardly of the conduit means and carrying circumferentially-spaced lower abutment surfaces engageable with the float in a lowermost position of the float, whereby air passing downwardly through the valve body passes about the float, among the guide ribs, among the abutment surfaces, and through the retainer ring into the conduit means, and water passing upwardly into the valve body buoys the float upwardly into sealing engagement with the valve seat surface to stop the water flow.

15. The combination of claim 14, wherein the annular retainer ring is snap-fittingly received between a plurality of nubs extending inwardly from the annular wall of the valve body and lower abutment surfaces of the guide ribs.

16. The combination of claim 14, further comprising a protective cap spaced over a top opening of the flow passage.

17. A check valve comprising:

a hollow tubular valve body having an interior annular wall, with a substantially constant radius, a plurality of guide ribs extending axially of said radially inwardly from said wall, and surfaces forming a fluid passage along the wall and ribs and a valve seat about a top fluid passage opening in the body; a port at a lower end of said valve body of substantially said radius and perpendicular to said valve body; and a valve float received axially slidably in the body inwardly of the guide ribs and having a closed, annular side wall, a closed top wall unitary therewith, and a seal on said top wall engageable with said valve seat, a retainer having substantially said radius positioned within said body below said float and removably engageable with at least one nub selectively located on said interior annular wall, said nub operable to retain said retainer between said float and said nub, whereby air can flow downwardly through the valve but water cannot flow upwardly out of the valve past the valve float.

* * * * *

UNITED STATES PATENT AND TRADEMARK OFFICE

CERTIFICATE OF CORRECTION

PATENT NO. : 4,168,705

DATED : Sep. 25, 1979

INVENTOR(S) : Alfred Raab

It is certified that error appears in the above-identified patent and that said Letters Patent are hereby corrected as shown below:

Column 3, line 45, change "preferably" to read --preferable--.

Claim 2, column 5, line 36, change "therealong" to read --thereamong--.

Signed and Sealed this

*Twenty-seventh* Day of *May 1980*

[SEAL]

*Attest:*

SIDNEY A. DIAMOND

*Attesting Officer*

*Commissioner of Patents and Trademarks*